United States Patent [19]

Denker

[11] Patent Number: 4,838,148

[45] Date of Patent: Jun. 13, 1989

[54] ACTUATOR

[76] Inventor: James M. Denker, 711 First Parish Rd., Scituate, Mass. 02066

[21] Appl. No.: 141,044

[22] Filed: Jan. 5, 1988

[51] Int. Cl.[4] ..... F01B 19/00; F16J 3/00

[52] U.S. Cl. ..... 92/90; 92/88; 92/137; 418/45

[58] Field of Search ..... 92/89, 90, 137; 418/45; 417/475, 476, 477

[56] References Cited

U.S. PATENT DOCUMENTS

| | | | |
|---|---|---|---|
| 2,581,830 | 1/1952 | Averill | 418/45 |
| 3,203,356 | 8/1965 | Jepsen | 418/153 |
| 3,381,583 | 5/1968 | Vansteene | 92/90 |
| 3,471,668 | 10/1969 | Wilkes | 92/89 |
| 3,627,452 | 12/1971 | Bellmer | 418/45 |
| 4,756,237 | 7/1988 | Shishkin et al. | 92/89 |

FOREIGN PATENT DOCUMENTS

| | | | |
|---|---|---|---|
| 0640050 | 12/1978 | U.S.S.R. | 92/90 |
| 0936382 | 9/1963 | United Kingdom | 92/89 |

*Primary Examiner*—Robert E. Garrett
*Assistant Examiner*—Thomas Denion

[57] ABSTRACT

An actuator including a housing having an internal cavity, a flexible but inextensible belt mounted so as to form an open-ended loop within the cavity, and a seal/-port assembly closing the open end of the loop and providing for fluid flow into the loop. One end of the loop is fixed. Fluid flow into the loop moves the belt and causes the area enclosed by (and in preferred embodiments the length of the periphery of) the loop to increase.

20 Claims, 2 Drawing Sheets

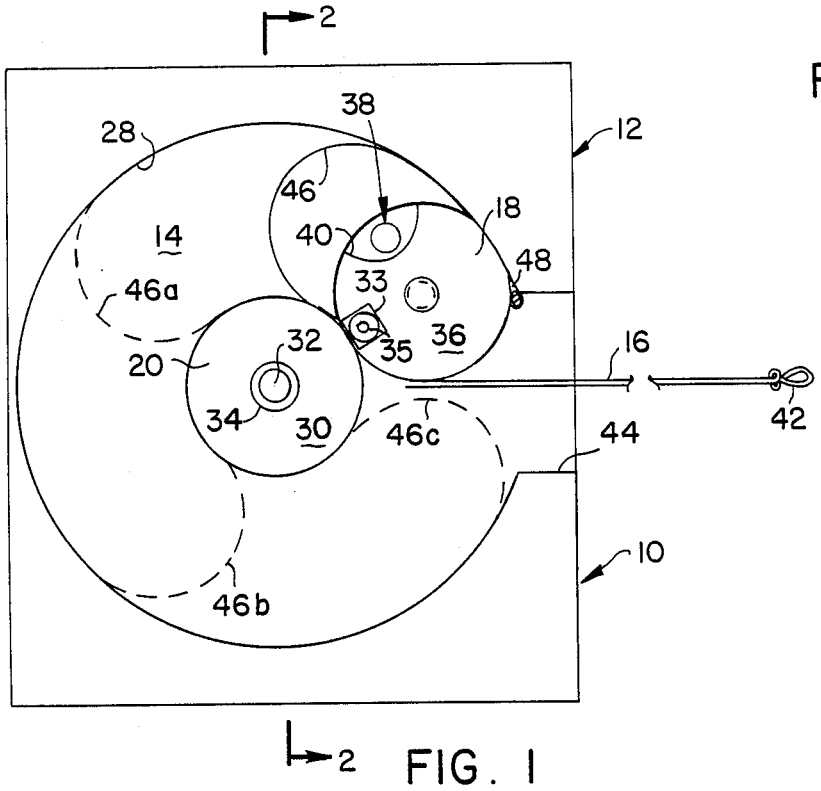
FIG. 1
FIG. 2
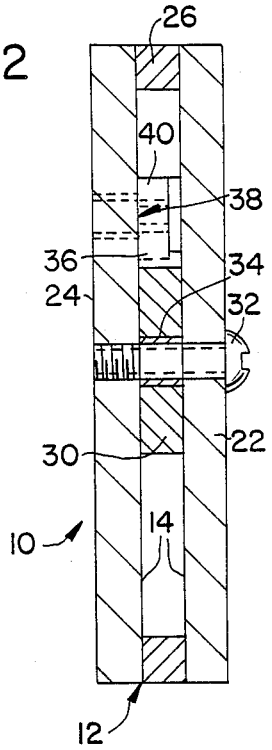
FIG. 3
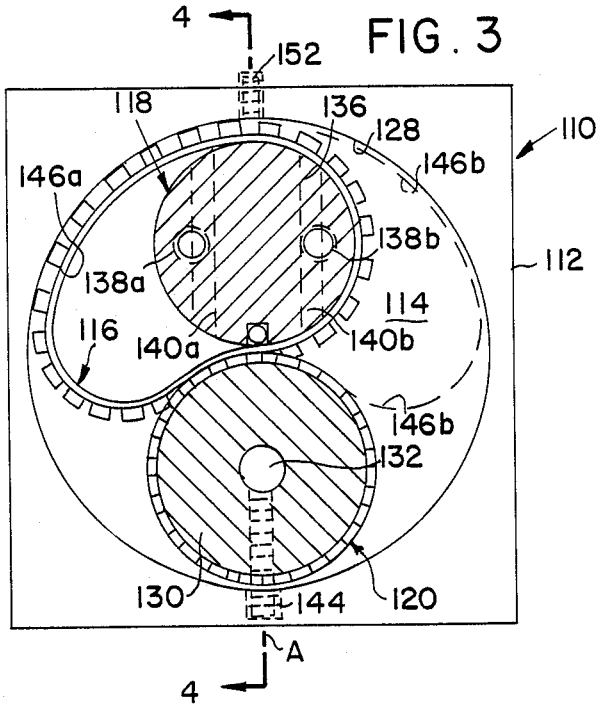
FIG. 4
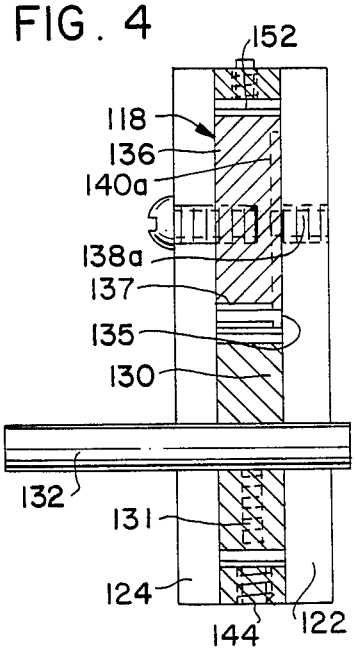

ACTUATOR

This invention relates to actuators and, more particularly to devices for converting fluid (e.g., air) pressure and flow to mechanical force and motion.

It is a principal object of the present invention to provide actuators which develop high force with low inertia, and which are more simple, less expensive and more efficient than those presently available.

Other objects include providing linear actuators in which the distance of available movement is greater than the overall size of the actuator housing, and rotary actuators which in a compact structure provide for greater overall angular rotation than heretofore available.

The invention features an actuator including a housing having an internal cavity, a flexible but inextensible belt mounted so as to form an open-ended loop within the cavity, and a seal/port assembly closing the open end of the loop and providing for fluid flow into the loop. One end of the loop is fixed. Fluid flow into the loop moves the belt and causes the area enclosed by (and in preferred embodiments the length of the periphery of) the loop to increase.

Preferred embodiments include linear actuators, some having two belts, loops and seal/port assemblies, in which increasing the size of the loop(s) moves one end of the belt(s) (and in some embodiments draws more of the belt(s) into the cavity); and two-way rotary actuators in which one belt forms two loops, the seal/port assembly is arranged to permit fluid under pressure to flow into a selected one (or both) of the loops, and the belt is coupled to a rotary shaft such that movement of the belt as the loops change in size causes rotation of the shaft.

These and other objects, features and advantages, will appear from the following detailed description of preferred embodiments of the invention, taken together with the attached drawings in which:

FIG. 1 is a simplified plan view (with top plate 24 removed) of an actuator embodying the present invention;

FIG. 2 is a sectional view, taken at line 2—2, of the actuator of FIG. 1;

FIG. 3 is a simplified plan view (with top plate 124 removed) of another actuator embodying the present invention;

FIG. 4 is a sectional view, taken at line 4—4, of the actuator of FIG. 3.

Figure 5:
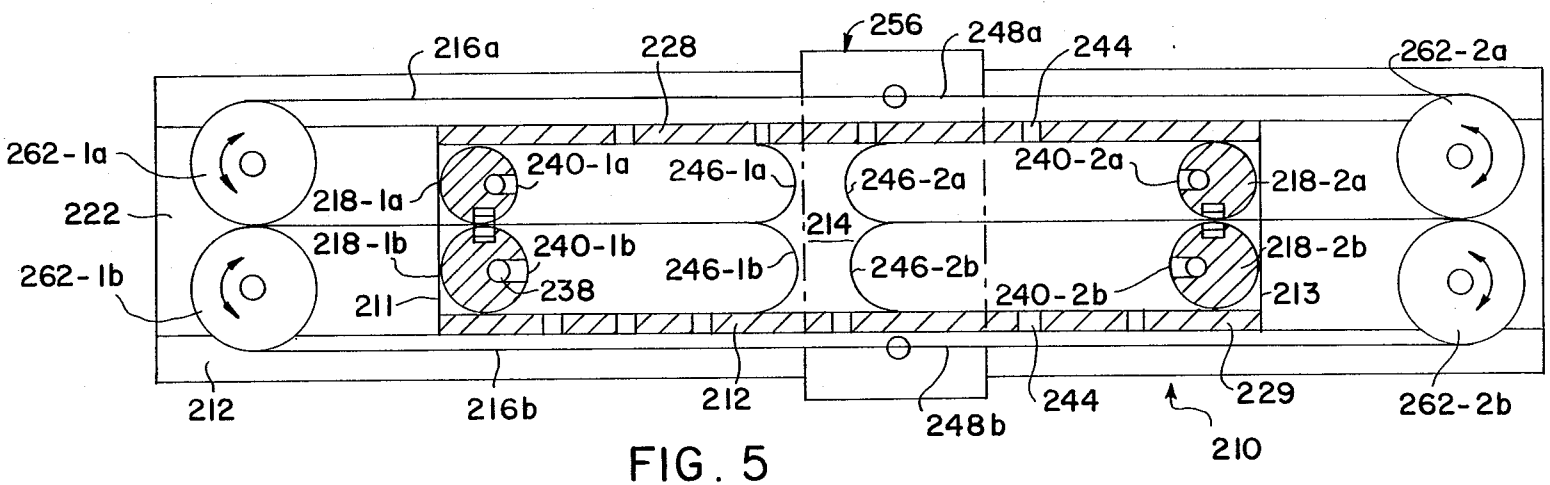
FIGS. 5–6 are somewhat simplified plan views of other actuators embodying the invention.

Turning more particularly to the drawings, FIGS. 1 and 2 show a linear actuator, generally designated 10, comprising a body assembly 12 defining a cylindrical interior cavity 14, a flexible and generally inextensible belt 16, a seal/port assembly generally designated 18, and a central support assembly 20.

Body assembly includes square flat top and bottom plates 22, 24 spaced about ¼ inch apart and defining the flat top and bottom of cavity 14. A center section 26 is sandwiched between 66 defines the cylindrical side walls 28 of cavity 14.

Central support assembly 20 includes a free-turning wheel 30 mounted on a screw 32 and cylindrical bushing 34 coaxially within cavity 14.

Seal/port assembly 18 has a cylindrical body 36 that substantially spans the gap between the periphery of wheel 30 of support assembly 20 and the cylindrical side wall 28 of cavity 14. A length of hollow flexible cylindrical tubing 35 is mounted in an axial recess 33 in the periphery of body 36 and provides a seal between body 36 and wheel 30. As shown, the relaxed diameter of tube 35 is somewhat greater than the distance between the base of recess 33 and the periphery of wheel 30, and the seal tube extends axially the full height of cavity 14. A cut-out in one side of seal/port assembly body 36 and a tapped hole in the bottom plate 22 provide an air-flow passage 38 that extends from a port 40 at the periphery of seal/port assembly 18 through body 36 to the outside of bottom plate 24 where it may be connected to an air source (not shown).

Belt 16 is a ¼ inch wide, about 0.010 in. thick polyester (e.g., "Mylar") tape. As shown, the free end 42 of belt 16 is outside actuator body 12, and the belt extends into cavity 14 through an opening 44 in center section 26 at one side of seal/port assembly 18. Within cavity 14, belt 16 passes between seal/port assembly 18 and central support assembly 20 (where in co-operation with seal tube 35 it provides an air seal) forms a loop 46 on the side of body 36 of seal/port assembly 18 in which port 40 is located, an then passes between cavity wall 28 and the outer side of body 36 where its other end 48 is effectively fixed in place. As shown, end 48 is wrapped around a short cylinder and the thus increased-in-thickness belt end is wedged into the bite of cavity wall 28 and seal/port assembly 18, holding end 48 in place and effectively providing an air seal at outer end 48 of loop 46. The side edges of the belt lightly engage the insides of top and bottom plates 22, 24, thus permitting a pressure differential to be established between the inside (i.e., the side facing port 40) and outside of the belt loop 46 in cavity 14. In operation, fluid (e.g., air) under pressure is (e.g., at normal shop air pressure of about 60–125 psig) introduced into actuator 10 through air flow passage 38. The resulting higher pressure on the inside of belt loop 46 causes more and more of the length of the belt 16 to be drawn into cavity 18 and "roll" into contact with the cylindrical wall 28 of cavity 18, increasing the size of the loop 46 until the belt contacts substantially the entire exposed inner cavity wall 28. In FIG. 1, the progressive expansion of loop 46 and movement of the belt 16 is indicated by dashed lines **46*a*, 46*b* and 46*c*. In each position, it will be noted that, as the loop increases in size, its sides lie along the cylindrical side wall of cavity 28 and the outer periphery of wheel 30**, and that the the portion of the loop spanning the cavity is essentially semicircular.

It will be seen that as loop 46 increases from its minimum peripheral length and area (not shown) in which it contacts the outer periphery of seal/port assembly body 30, to its maximum size (indicated by dashed line **46*c*), belt free end 42 moves toward actuator a distance that is several times the overall size of actuator 10**. For example, an actuator about 3.5 inches square provides for about 10 inches of travel of the belt free end.

As the belt loop 46 within cavity 14 expands, the air in the portion of cavity 14 outside the loop exits from the cavity through opening 44. Rotation of wheel 30 of support assembly 20 in response to belt movement helps keep frictional losses to a minimum.

Figure 6:
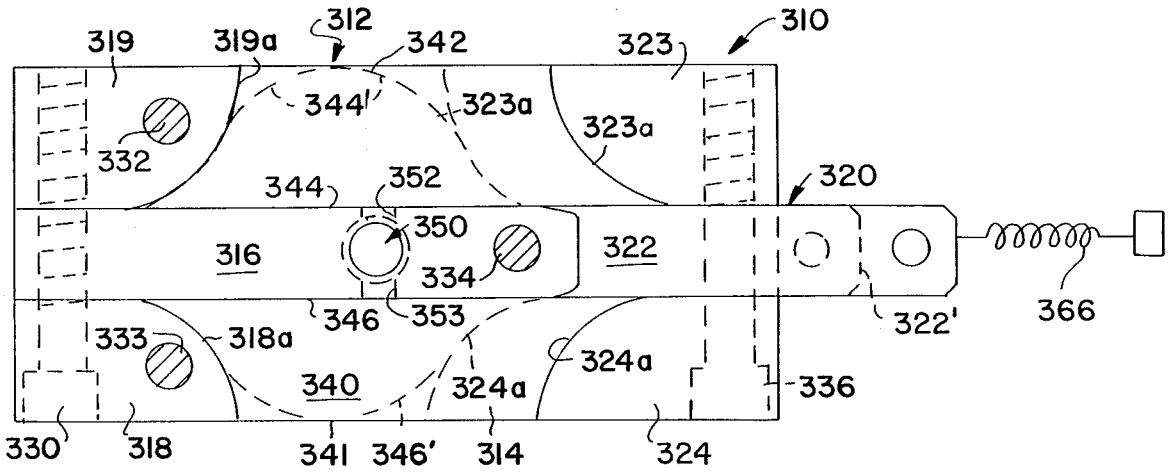

FIGS. 3–6 show other actuators embodying the present invention. FIGS. 3, 5, and 6 are slightly simplified top plan views, in which the top plates of the actuators have been removed for calarity.

FIGS. 3 and 4, for example, illustrate a rotary actuator 110 embodying the invention. Many of the parts of actuator 10 are the same as (or correspond to) parts of actuator 110, and are identified by reference numbers 100 greater than those used to identify the corresponding parts of actuator 10. Similar numbering systems are used in FIGS. 5–6.

As shown most clearly in FIG. 3, the body 112 of actuator 110 defines a cylindrical cavity 114 in which is provided a toothed (in the illustrated embodiment, a 1/5 inch pitch, 25 tooth) belt 116 made, e.g., of molded urethane with polyester or steel reinforcement, a support assembly 120 and a seal/port assembly 118. Support assembly 120 is mounted in the bottom (as viewed in FIG. 3) of cavity 114 and includes a 12 groove (or tooth) timing belt pulley 130 fixed by a set screw 131 to a ¼ inch diameter output shaft 132. As shown, belt 116 is positioned so that, along most of its length, its teeth face outward and contact the cylindrical side wall 128 of cavity 114. Seal/port assembly 118 is mounted in the top of cavity 114 (with its axis and those of cavity 114 and support assembly 120 aligned along a diameter A of cavity 114) and includes a body 136 the diameter of which is substantially equal to the radius of cavity 114. The portion of belt 116 between seal/port assembly 118 and the cavity side wall 128 is clamped in place by a belt clamp 152 that holds the belt tightly against the periphery of seal/port assembly body 136. On the other side of seal/port assembly 118, the belt 116 passes between seal/port assembly body 136 and central support assembly pully 130, with the belt teeth engaging the teeth on central support pulley 130. As in the FIG. 1 and 2 embodiment, a sealing tube 135 is mounted in a recess 137 in the periphery of seal/port assembly 118 and provides the desired air seal.

As is evident, belt 116 is positioned entirely in cavity 114, and forms two loops, designated **146*a*, 146*b* respectively, Loop 146*a* is located on one side (the left as viewed in FIG. 3) of line A and loop 146*b* is located on the other side of line A. To permit air flow into (or out of) either loop, two air flow passages, designated 138*a*, 138*b* respectively, pass through seal-port assembly 118. Each air passage is associated with one of loops 146*a*, 146*b* and has at its inner end a port 140*a*, 140*b* that opens into the associated loop. A threaded vent/vacuum opening 144 is provided in the cavity side wall diametrically opposite belt clamp 152**.

In operation, output shaft 132 rotates in one direction when air under pressure is applied to one of air flow passages **140*a* and 140*b*, and the other air flow passage and vent opening 114 are open to the atmosphere. For example, when air under pressure is applied through air flow passage 138*a*, loop 146*a* will increase (and conversely loop 146*b* will decrease) in size and the resulting belt movement will cause shaft 132 to rotate counter clockwise (as viewed in FIG. 3) until loop 146*a* reaches its maximum size in which (again as viewed in FIG. 3) loop 146*b* is pulled tight against the periphery of seal/port body 136. Shaft 132 is caused to rotate (i.e., clockwise as viewed in FIG. 3) in the other direction results when air pressure is applied through air flow passage 138*b***.

It will be recognized that the movement of belt 116 and the resulting rotation of shaft 132 is caused by creating a pressure differential across the loop which is to increase in size. Accordingly, rather than connecting one air flow passage to a source of fluid under pressure and venting both the other passage and the vent opening, the same pressure differential and resulting rotation of output shaft 132 could be effected by connecting opening 144 and the "other" air flow passage to vacuum (or another sub-atmospheric pressure source), while opening the "one" air flow passage to the atmosphere.

The amount of rotation of shaft 132 that can be obtained depends principally on the relationship between the overall length of belt 114 and the pitch diameter of pulley 130. The twenty-five tooth belt 116 and 20 groove timing belt pulley 136 provide for approximately 90° of overall rotation. A shorter belt would provide less rotation (e.g., a 21 tooth belt would provide about 18° rotation) and more rotation would be provided by a longer belt (e.g., 180° by a 30 tooth belt). The amount of available rotation also can be changed by using different timing belt pulleys, e.g., a pulley having smaller pitch diameter would provide greater rotation, and a pulley with a greater pitch diameter would provide less.

FIG. 5 illustrates an actuator system 210 which controls the linear reciprocation of a slide 256. The open-ended housing 212 of system 210 includes a longitudinally-extending cavity 214 having a pair of seal/port assemblies mounted at each of the otherwise open ends 213, 211 of the cavity. A number of vent openings 244 are spaced along each of the cavity side walls 228 and 229. Seal/port assemblies **218-1*a* and 218-1*b* are positioned side-by-side across one end 211 of cavity 214; and seal/port assemblies 218-2*a* and 218-2*b* are positioned side-by-side in the other open end 213 of cavity 214. An air flow passage 238 extends through each of seal/port assemblies 218 from a respective threaded bore in the back of mounting plate 222 to a port 240 at the inner side of the respective seal/port body 236**.

A pair of freely-rotatable pulleys **262-1*a* and 262-1*b* are mounted adjacent end 211 of cavity 214, and a second pair of freely rotatable pulleys 262-2*a* and 262-2*b* are mounted adjacent end 213. As shown, the two pairs are positioned along the center line of the housing 212 and the two pulleys in each pair are spaced apart a distance that is only slightly greater than twice the combined thicknesses of flexible, substantially inextensible belts 216*a*, 216*b*** passing between the pulleys.

One end of belt **216*a* is fixed in place between the outer side of seal/port assembly 218-1*a* and the adjacent (the top as viewed in FIG. 6) side wall 228 of cavity 214, where it forms the seal between the seal/port assembly and the cavity side wall. Belt 216*a* forms loop 246-1*a* in cavity 214 and passes between seal/port assemblies 218-1*a* and 218-1*b* to the outside of housing 212. Outside housing 212, belt 216*a* passes around pulleys 262-1*a* and 262-2*a* (the belt run 248*a* between the two pulleys is generally parallel to and spaced slightly from the side of housing 212) and then back into housing 212, this time through end 213. At end 213, the belt (after passing between seal/port assemblies 218-2*a* and 2*b*) forms loop 246-2*a*, and its other free end is secured between seal-port assembly 218-2*a* and cavity side wall 228**.

One end of the other belt **216*b* is sealed between seal/port assembly 218-1*b* and the bottom side wall 229 of cavity 214. Belt 216*b* forms loop 246-1*b* and, after passing out of the cavity 214 between seal/port assemblies 218-1*a* and 218-1*b* at end 211 of housing 212, passes (in succession) around pulleys 262-1*b* and 262-2*b*. From pulley 262-2*b*, belt 216*b* passes into end 213 of cavity 214, forms loop 246-2*b* in the cavity and then continues to between seal/port assembly 218-2*b* and the bottom adjacent cavity wall 229**, where its other end is fixed in place.

Slider 256 is mounted on housing 212 movement back-and-forth longitudinally of the housing. As somewhat schematically shown in FIG. 5, the run 248*a* of belt 216*a* between pulleys 262-1*a* and 262-2*a* is connected to one side (the top as shown) of slider 256. The run 248*b* of belt 216*b* between pulleys 262-1*b* and 262-2*b* is connected to the bottom of the slider.

In operation, the fluid passages extending from ports 240-1*a* and 240-1*b* in the seal/port assemblies 218-1*a* and 218-1*b* at end 211 of cavity 214*a* are connected to one source of pressure ($P_1$, not shown) and the passages from the ports 240-2*a* and 240-2*b* at end 213 of cavity 214 are connected to another pressure source ($P_2$, not shown). Applying relatively higher pressure to ports 240-1*a* and 240-1*b* from source $P_1$ will cause a pressure differential to exist across belt loops 246-1*a* and 246-1*b* and causes them to lengthen (while, correspondingly, loops 246-2*a* and 246-2*b* at the other end of the cavity are shortened), thus moving slider 256 to the left (as shown in FIG. 5). Similarly, the slider 256 is moved to the right when higher pressure is applied to ports 240-2*a* and 240-2*b* from source $P_2$.

It will be noted that the outside portion of each belt contacts and is supported by cavity side walls 218, 219, but that the inside portion of each of the loops is adjacent of and contacts and is supported by, the inside portion of the adjacent loop. For example, the adjacent inside portions of loops 246-1*a* and 246-1*b* contact and support each other, as do the adjacent inside portion of loops 246-2*a* and 246-2*b*. Since the pressure in both loops of each pair is the same (e.g., loops 246-1*a* and 2*a* are connected to the same pressure source), the adjacent and contacting inside portions of each pair of loops will be essentially straight and will lie along the center line of the system.

In a somewhat modified embodiment, it will be noted that any of pulleys 262 could be fixed (e.g., keyed) to an output shaft. In this event in movement of the belts would cause the shaft to rotate and the system would produce both linear (i.e., slider 256) and rotary (i.e., the shaft to which the pulley is fixed) output.

FIG. 6 illustrates a linear actuator 310 comprising a body assembly 312 having rectangular top and bottom plates 314, a fixed sealing bar 316 sandwiched between the plates, a pair of fixed support blocks 318, 319 mounted at one end of fixed sealing bar 316 and housing assembly 312, and a movable bar/block assembly (generally designated 320) mounted (a sliding fit) between top and bottom plates 314 at the other end of housing 312. As shown, the bar 322 of movable bar/block assembly 320 is longitudinally aligned with fixed sealing bar 316, and movable support blocks 323, 324 are secured to the opposite sides of movable bar 322. Each of support blocks 318, 319, 323, 324 defines a quarter-circular-cylindrical surface (designed 318*a*, 319*a*, 323*a* and 324*a*, respectively) facing (i.e., convex towards) the center of housing assembly 312.

Blocks 318 and 319 are secured to fixed sealing bar 316 by cap screw 330, and the assembly of fixed blocks 318, 319 and fixed bar 316 is fixed between top and bottom plates 314 by cap screws 332, 333 through blocks 318, 319, and cap screw 334 through the far end of bar 316. Similarly, cap screw 336 attaches blocks 323 and 324 to movable bar 322.

As will be seen, top and bottom plates 313, 314 and support block quarter-cylindrical surfaces 318*a*, 319*a*, 323*a* and 324*a* form a cavity (generally designated 340 and open at its sides 341, 342) within housing assembly 312. A pair of flexible, inextensible belts 344, 346 are mounted within the cavity, one on each side of bars 316, 322. One end of belt 344 is held between block 318 and bar 316; the other end is fixed between movable block 323 and bar 322. Similarly, the two ends of belt 346 are fixed between, respectively, block 318 and bar 322, and block 324 and bar 322. A drilled fluid passage 350 extends from bottom plate 314 to ports (designated 352, 353 respectively) on opposite sides of fixed bar 316 closely adjacent the center of the housing cavity. The lengths of belts 344, 346 are such that the belts will be straight and lie flat along the sides of bars 322 and 316 when movable block/bar assembly 320 is in its "starting-pull" position (shown in solid lines in FIG. 6), and bulge outwardly and lie along block surfaces 318*a*, 319*a*, 323*a*, 324*a* (as shown in dashed lines 344', 346') when movable block/bar assembly 320 is in its "finishing-pull" position (shown in dashed lines 322' in FIG. 6).

To move the belts (and hence block/bar assembly 320) from the "starting-pull" portion to the "finishing-pull" position, air under pressure is applied to passage 350 (and thus through ports 352, 353 and between the side of fixed bar 316 and the adjacent one of belts 344, 346). The relatively higher air pressure on the inside (i.e., adjacent bar 316) of the belts causes the belts to bulge outwardly and moves bar 322 to the left as viewed in FIG. 6. It will be noted that the force applied to bar 322 changes as the belts 344, 346 bulge outwardly, and the volume enclosed by each belt increase. The force is maximum when the belts are straight (i.e., block/bar assembly 320 is at the "starting-pull" position) and decreases to zero when the volume of the loop is at its maximum (i.e., assembly 320 is in the "finishing-pull" position.

When air pressure through passage 350 is relieved, spring 360 returns assembly 320 to the "starting-pull" position.

These and other embodiments will be within the scope of the following claims.

What is claimed is:

1. An actuator for converting fluid pressure and flow into mechanical movement and force comprising:

a housing defining an interior cavity having generally parallel top and bottom walls;

a flexible and generally inextensible belt mounted at least partially within said cavity, a portion of the belt within the cavity provid an open loop, the belt being movable within the cavity to vary the area of the open loop, and being so positioned that the top and bottom of the belt portion forming the loop are closely adjacent the top and bottom walls of the cavity;

a seal closing the open end of said open loop, said seal sealingly engaging spaced-apart portions of the inner surface of said loop adjacent the opposite ends of said open loop; and, means for causing the pressure of fluid within the open loop to be greater than the pressure of fluid within the cavity but outside the open loop such that the difference in pressure causes the belt to move so as to increase the area enclosed by said seal and said loop, said movement of said belt being adapted to provide a mechanical output of said actuator.

2. The actuator of claim 1 wherein one end of the portion of said belt forming said loop is fixed relative to said cavity and movement of said belt within the cavity varies the length of the portion of the belt forming the open loop.

3. The actuator of claim 2 wherein said belt extends from within said cavity through an opening to outside said housing, and said difference in pressure increases the size of said loop and causes portions of said belt outside said housing to be drawn through said opening into said housing.

4. The actuator of claim 2 wherein one end of the portion of said belt forming said open loop is fixed relative to said cavity, movement of said belt within said cavity varies the length of the portion of the belt forming the opening loop, a generally circular member is mounted within said cavity for rotation about its central axis, and the periphery of said member engages the portion of said belt forming said open loop adjacent the end of said loop spaced of said loop such that movement of said belt causes rotation of said circular member.

5. The actuator of claim 4 including an output shaft operatively connected to said circular member.

6. The actuator of claim 5 wherein said circular member is a gear and said belt includes means engaging the teeth of the gear.

7. The actuator of claim 1 wherein said belt is toothed on the outer side thereof and said outer side is positioned to contact a side wall of said cavity.

8. The actuator of claim 1 including within said cavity belt portions defining a pair of said open loops and a said seal associated with and closing the open end of each of said loops, and means for selectively causing the pressure of fluid within a selected one of said loops to be greater than the pressure of fluid within the cavity outside the selected one of said loops such that the differences in pressure causes the belt portion forming the selected one of said loops to move so as to increase length of the portion of the belt forming the selected loop and the area enclosed by the selected loop and the said seal associated therewith.

9. The actuator of claim 1 wherein said cavity has a sidewall comprising a portion of a cylindrical surface.

10. The actuator of claim 1 including a generally circular member mounted within said cavity for rotation about its central axis, and wherein said seal and said means comprise a seal/port assembly extending generally between the periphery of said circular member and a side wall of said cavity, one end of the portion of said belt forming said open loop is positioned between said seal/port assembly and the side wall of said cavity, the other end of the portion of said belt forming said open loop passes between said seal/port assembly and the periphery of said circular member and engages said circular member such that movement of said belt causes rotation of said circular member, and said seal/port assembly includes a fluid flow passage extending from a port at the side of said assembly facing into said open loop and positioned to provide for flow of fluid under pressure into the area bound by said assembly and the portion of said belt forming said loop.

11. The actuator of claim 10 wherein said belt forms a pair of said loops on opposite sides of said seal/port assembly, and said seal/port assembly includes a pair of fluid passages and ports, each of said ports being positioned to provide for flow of fluid into and from the area bound by said seal/port assembly and the portion of said belt forming a respective one of said open loops.

12. The actuator of claim 11 wherein said seal/port assembly and said circular member extend across essentially the full width of said cavity.

13. The actuator of claim 10 wherein said cavity side wall is cylindrical.

14. The actuator of claim 1 wherein one end of said belt is fixed relative to said cavity, a second portion of said belt is fixed to a member that is movable relative to the portion of said housing defining said cavity, and said movement of said belt causes relative linear movement of the portion of said housing defining said cavity and said member.

15. The actuator of claim 14 including a pair of said belts each having one end thereof fixed relative to said cavity and a second portion thereof fixed to said linearly movable member.

16. The actuator of claim 14 including a generally circular member mounted for rotation about the central axis thereof, and wherein said belt engages said circular member and said movement of said belt causes rotation of said circular member.

17. The actuator of claim 14 wherein said cavity is generally rectangular, a seal/port assembly is mounted adjacent each end of said cavity, and said belt is arranged to form two of said loops, each of said loops being associated with and engaging spaced-apart portions of one of said seal/port assemblies each of said seal/port assemblies including a fluid flow passage extending from a port at the side thereof and positioned to provide for flow of fluid under pressure to increases the area of the said loop associated therewith.

18. The actuator of claim 17 including a pair of said seal/port assemblies mounted adjacent each end of said cavity and a pair of said loops.

19. The actuator of claim 1 wherein said cavity includes a side wall that defines at least a portion of said seal.

20. The actuator of claim 1 wherein said cavity includes a side wall, movement of said belt within said cavity varies the length of the portion of the belt forming the open loop, one end of the portion of the belt forming the open loop is fixed relative to said cavity with the inner surface of said one end engaging said seal and the outer surface of said one end engaging the side wall of said cavity, and the other end of the portion of the belt forming the open loop is movable relative to the seal.

* * * * *

UNITED STATES PATENT OFFICE

CERTIFICATE OF CORRECTION

Patent No. 4,838,148 Dated June 13, 1989

Inventor(s) James M. Denker

It is certified that error appears in the above-identified patent and that said Letters Patent is hereby corrected as shown below:

Col. 1, line 62, "66" should be --plates 22, 24, and a cylindrical bore through center section 26--

Col. 7, line 20, "end of said loop spaced of said loop" should be --end of said loop spaced from said fixed end of said loop--

Signed and Sealed this

Sixth Day of February, 1990

*Attest:*

JEFFREY M. SAMUELS

*Attesting Officer*

*Acting Commissioner of Patents and Trademarks*